United States Patent [19]

Ueda

[11] Patent Number: 4,590,350

[45] Date of Patent: May 20, 1986

[54] AUTOMATIC HEATING APPARATUS EMPLOYING WEIGHT AND GAS SENSORS

[75] Inventor: Shigeki Ueda, Yamatokoriyama, Japan

[73] Assignee: Matsushita Electric Industrial Co., Ltd., Osaka, Japan

[21] Appl. No.: 682,511

[22] Filed: Dec. 17, 1984

[30] Foreign Application Priority Data

Dec. 20, 1983 [JP] Japan ..... 58-240108

[51] Int. Cl.[4] ..... H05B 6/68

[52] U.S. Cl. ..... 219/10.55 B; 219/10.55 E; 219/10.55 M; 219/492; 99/325

[58] Field of Search ..... 219/10.55 B, 10.55 R, 219/10.55 Z, 10.55 M, 492, 518, 497; 99/325

[56] References Cited

U.S. PATENT DOCUMENTS 4,255,639 3/1981 Kawabata et al. ..... 219/10.55 B 4,317,977 3/1982 Buck ..... 219/10.55 B 4,379,964 4/1983 Kanazawa et al. ..... 219/492

4,383,158 5/1983 Niwa ..... 219/10.55 B 4,390,768 6/1983 Teich et al. ..... 219/10.55 B 4,463,238 7/1984 Tanabe ..... 219/10.55 B

*Primary Examiner*—Philip H. Leung

*Attorney, Agent, or Firm*—Spencer & Frank

[57] ABSTRACT

A heating apparatus comprising a gas sensor for detecting gas or steam emanated from an object to be heated, and a weight sensor for detecting the weight of the object including its container. The heating time calculated on the basis of the detected weight of the object and the detection time required for the detection of a predetermined amount of gas or steam are monitored in parallel and properly selected by a microcomputer. The reheating operations are instructed by a single reheating key. At the same time, the heated state of the object is monitored by a plurality of sensors thereby providing an improvement in safety.

9 Claims, 9 Drawing Figures

F·I G. 6

AUTOMATIC HEATING APPARATUS EMPLOYING WEIGHT AND GAS SENSORS

BACKGROUND OF THE INVENTION

The present invention relates to an automatic heating apparatus, or more in particular to an automatic heating apparatus using a weight sensor and a gas sensor.

Automatic heating apparatuses in which the heating time is automatically regulated find wide applications. An automatic microwave oven, for example, is highly evaluated for its operating convenience and accounts for a considerable share of the microwave oven market. An automatic microwave oven comprises a gas sensor responsive to vapour, steam or various gases generated during the heating of an object to be heated, or a thermistor for measuring the temperature of the air flowing into or from the heating chamber thereof. In any of these types, the manner of heating the object is divided into a number of heating steps according to the type of food involved. For reheating, for instance, the operation is often performed through the actuations of two or three select keys. FIG. 1 is a perspective view of such an automatic heating apparatus, and FIG. 2 is a diagram showing the essential parts of an operating panel for the apparatus. A door 2 adapted to be opened or closed as desired and an operating panel 3 are mounted on the front of a body 1. Various select keys 4 are arranged on the operating panel 3 so that the manner of heating may be selected according to the food involved. For reheating, the shown example has three keys labeled "Cold boiled rice", "Soup" and "Curry/Stew" to enable an appropriate select key to be used according to the type of food. This is due to the fact that if the heating is finished at the time point when water steam or gas has emanated from the food or the surface temperature of the food has reached a predetermined level, the central portion of some food may not be sufficiently heated and therefore must be additionally heated and that the length of time of the additional heating varies with the type of food involved. This relationship is shown in FIG. 3 for a gas sensor responsive to vapour or steam generated from the food. Assume that $T_1$ designates the length of time required to reach the detection point where a predetermined amount of steam is detected. It is recommended that the heating of the cold boiled rice be stopped upon the detection of the steam, and in the case of the soup, an additional heating time of $K_1T_1$ is required to be added to the time $T_1$ to prevent it from becoming lukewarm. Based on experience, $K_1$ is a constant selected to be about 0.1 to 0.5. Melting food such as curry or stew must be further heated for an additional time of $K_2T_2$, where $K_2$ is determined at about 0.3 to 0.8. In this way, the value K varies with the type of food because steam is generated differently from different foods. For example, some foods exhibit thermal characteristics of low heat conduction or convection, and others generate steam fron only parts thereof. The user, therefore, must select the proper select key depending on the type of food to be heated. Since the menus described on the keyboard usually shows only two or three items, it is necessary to refer to the cuisine book or the like to determine whether a given food can be automatically cooked in the apparatus. When it is desired to reheat macaroni, for instance, the user unfamiliar with the operation can not decide which keys should be used. A market survey has shown that in spite of the frequent use of the reheating function, only a small percentage of users use the automatic mode of reheating. The troublesome operation for selecting the select keys may be one reason for this fact.

The object of the present invention is to obviate this disadvantage of the conventional apparatuses and to provide an automatic heating apparatus which is easy to operate, and in which the plurality of reheating select keys that have so far been used for a plurality of food types are replaced by a single select key.

SUMMARY OF THE INVENTION

In order to achieve the above-mentioned object, an automatic heating apparatus according to the present invention comprises a gas sensor and a weight sensor for detecting the weight of an object to be heated, wherein the detection threshold value of the gas sensor is set to a "deep" value to determine a first heating time, and a second heating time associated with the total weight (including a tare) of the food involved is calculated by using the weight sensor, so that the heating of the food is controlled by parallel monitoring of the first and second heating time periods. Specifically, the heating time for the food with a small K value is controlled by the weight sensor, and the food with a large K value by the gas sensor, thus enabling a single key to cover the reheating operation of all foods.

BRIEF DESCRIPTION OF THE DRAWINGS

The present invention will be apparent from the following detailed description taken in conjunction with the accompanying drawings, in which.

DESCRIPTION OF A PREFERRED EMBODIMENT

An embodiment of the present invention will be explained below with reference to the attached drawings.

Figure 1:
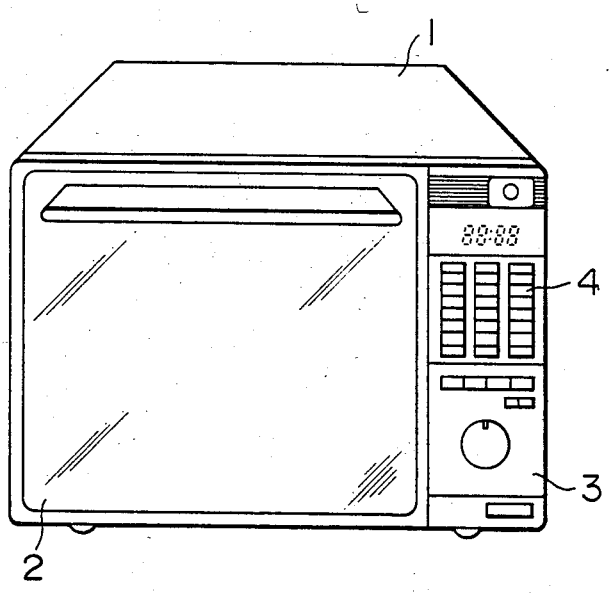
FIG. 1 is a perspective view of the body of an automatic heating apparatus.
Figure 2:
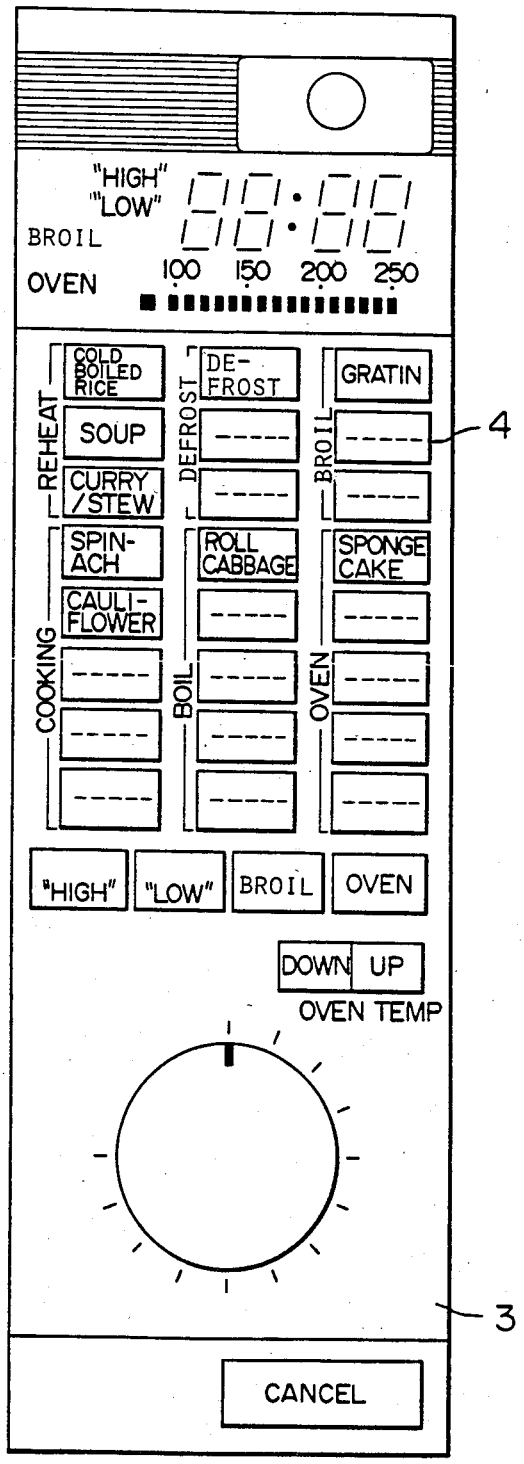
FIG. 2 PRIOR ART
FIG. 2 is an enlarged front view of an operating panel according to the prior art.
Figure 4:
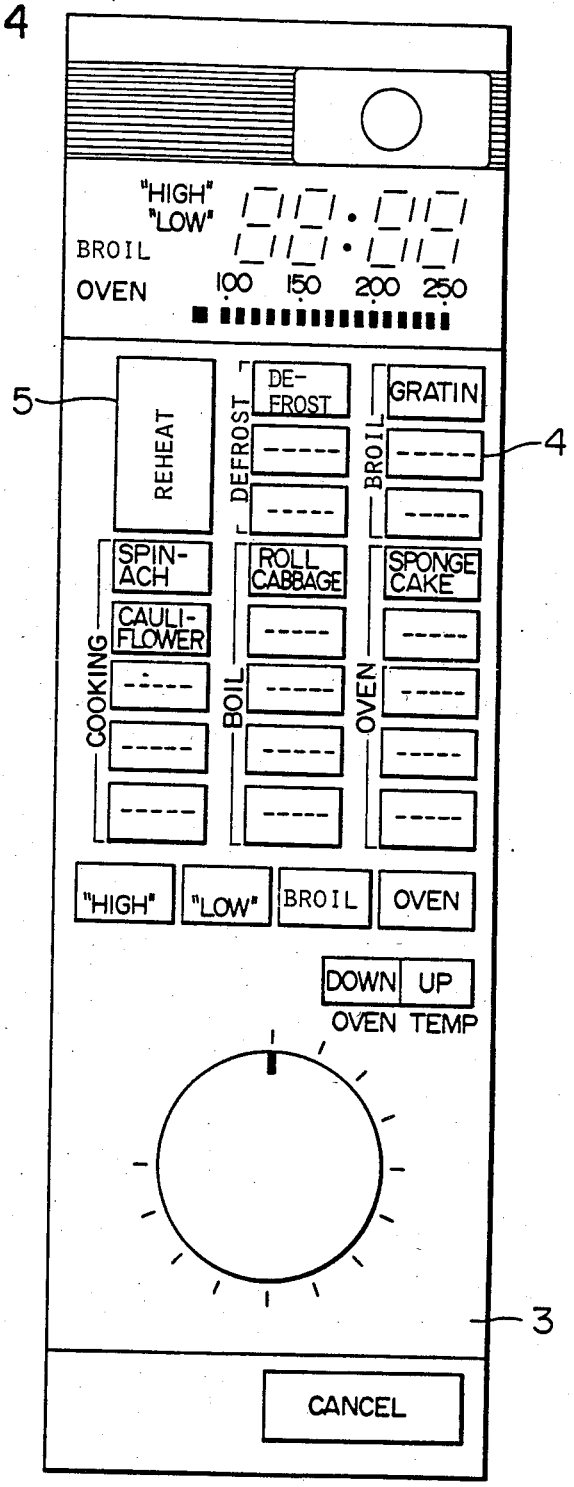
FIG. 4 is an enlarged front view of an operating panel according to an embodiment of the present invention.

FIG. 4 is a diagram showing the essential parts of an operating panel according to the present invention. Various select keys 4 are arranged on an operating panel 3, in which the reheating operations can be instructed by a single "reheating" key 5. The reheating functions which have thus far been achieved by operations of two or three keys (See FIG. 2) can be achieved by operation of the single "reheating" key 5 for the reason described below.

Figure 3:
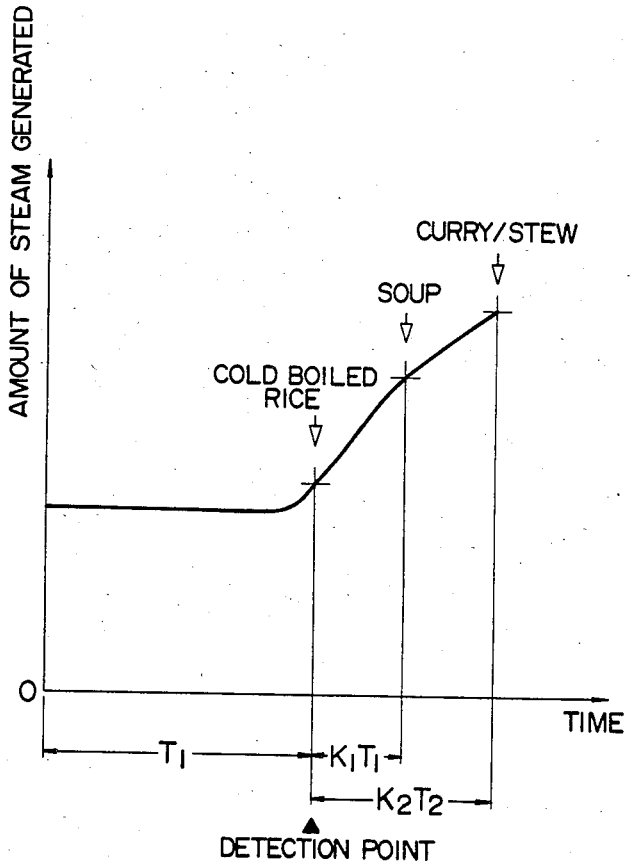
FIG. 3 PRIOR ART
FIG. 3 is a diagram showing the detection and control involved when reheating keys are used.
Figure 5:
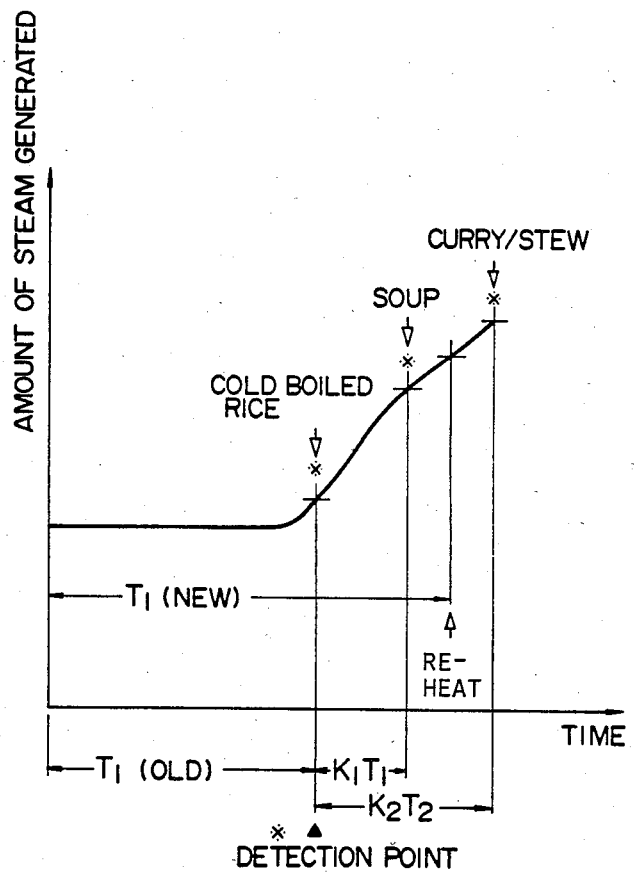
FIG. 5 is a diagram showing the detection and control involved when the reheating key of the same embodiment is used.

The automatic heating apparatus according to the present invention comprises a couple of sensor means. The first sensor means is a gas sensor for detecting gaseous medium such as gas, vapour or steam generated from the food involved. For example, the absolute humidity sensor Neo-Humiceram of Matsushita or the gas sensor made by Figalo may be used as such a gas sensor. FIG. 5 is a diagram showing a detection point of such a gas sensor, in which the three points marked with "*" represent those plotted in the prior art of FIG. 3, and "Reheat" indicates a new detection point according to the present invention. The new detection point has a threshold value which is much "deeper" than that of the prior art, and is located at about the point just midway between the finish points of "Soup" and "Curry/Stew" of the prior art. According to this detection point, the soup will be finished slightly hotter and the currry/stew or other melting food a little less warm. This, however, has no adverse effect for practical purposes. The cold boiled rice, on the other hand, would be considerably overheated and begin to congregate in rubber-like form.

Figure 6:
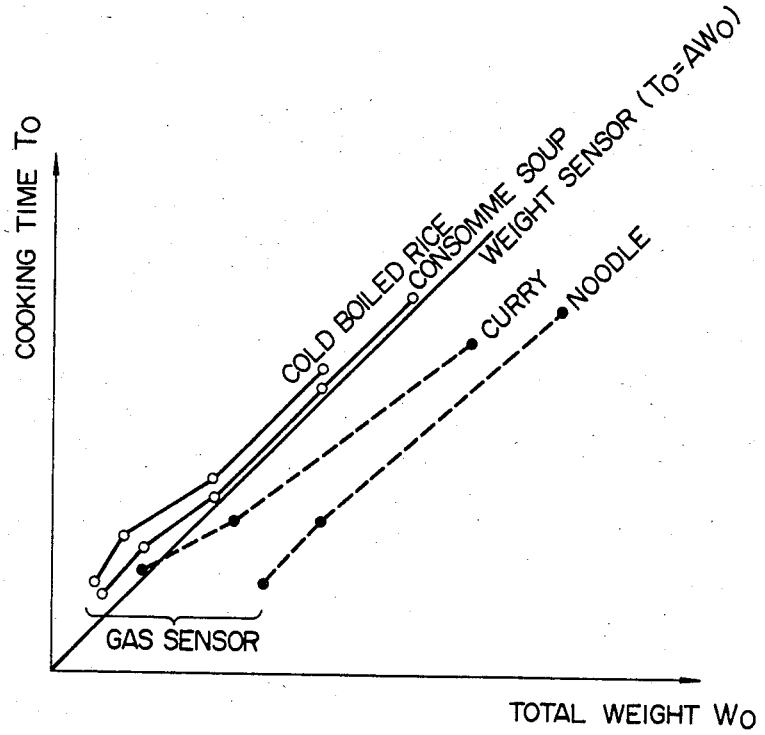
FIG. 6 shows the control by a weight sensor of the same embodiment.

The second sensor means according to the present invention is a weight sensor for preventing the cold boiled rice and certain soups from being overheated. The detection points of a gas sensor with the new threshold value are plotted for each item of the menu in FIG. 6. In this case, the cold boiled rice and consomme soup will be overheated, while the curried rice and noodle will be finished substantially in satisfactory manner. The overheated conditions of the cold boiled rice and consomme soup are obviated by the method described below.

Specifically, the total weight of a load which includes the food and its container is measured, and the cooking time is calculated from the weight thus measured, so that the result of the calculation and the detection by the gas sensor are checked and controlled in parallel (by OR logs circuitry). If the equation of the calculation is properly selected, only those items of the menu which would be overheated with the gas sensor such as the cold boiled rice, consomme soup or milk can be finished with the weight sensor. This is because the cold boiled rice, consomme soup, milk or like food is generally served in a rice bowl or cup having a large volume (150 to 400 cc) as compared with the food weight itself (70 to 200 g), and therefore the weight of the food accounts for a considerable proportion of the total weight. The total weight being the same, the gas sensor works on such a food later than on noodle, curry or stew, as seen by the highest positions taken by them among the number of menu items in FIG. 6. As a result, such foods as cold boiled rice, consomme soup and milk can be automatically cooked in dependence upon the weight sensor.

Experiments show that a simple equation $T_0=AW_0$, where A is a constant may be used for the calculation. The constant A of about 0.3 was found preferable and proper (for $T_0$ in seconds, and $W_0$ in g). The cold boiled rice, consomme or milk was finished in satisfactory condition by this weight time $T_o$. Also, a small volume (one half of a cup) of curry, noodle or boiled vegetable was finished by the weight sensor in more satisfactory manner than by the gas sensor. The weight sensor has thus the function to compensate for the slow responsiveness (late finish of small volume) of the gas sensor.

Figure 7:
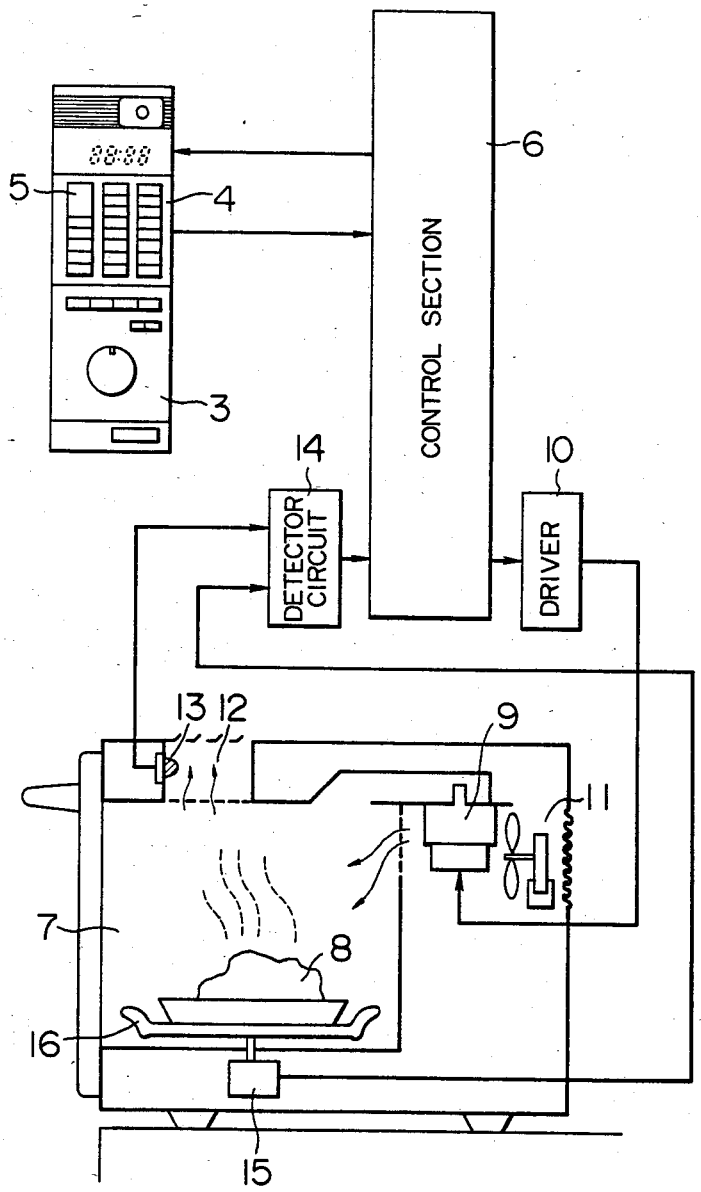
FIG. 7 is a diagram showing a configuration of the same embodiment.

The configuration of an exemplary automatic high-frequency heating apparatus of this kind will be described. In FIG. 7, various commands entered by way of the select key 4 on the operating panel 3 are decoded by a control section 6, where various indications are made to control the further progress of heating. Numeral 5 designates a "Reheating" key.

An object 8 to be heated is placed in a heating chamber 7, and is heated by a magnetron making up high-frequency source 9. The power of the magnetron 9 is controlled by the control section 6 through a driver 10. A blower 11 is for cooling the magnetron 9 on the one hand and ventilating the heating chamber 7 on the other hand. Numeral 12 designates an exhaust air guide for discharging the exhaust air out of the apparatus. The exhaust air guide 12 contains therein a gas sensor making up the first sensor means 13 capable of detecting gas or steam and informing the control section 6 of the progress of heating through a detector circuit 14.

A weight sensor making up second sensor means 15, on the other hand, is for measuring the total weight of the object 8 on the rest 16. The control section 6 is comprised of a microcomputer, the gas sensor 13 of the absolute humidity sensor Neo-Humiceram of Matsushita or the gas sensor of Figaro, and the weight sensor 15 of a distortion gauge or the like.

Unlike in the embodiment under consideration where the simple equation ($T_0=AW_0$) is used for the calculation of the weight time, another equation of higher degree may be used appropriately, or an equation $T_0=AW_0+B$ (B:Constant) also meets the requirement. Further, instead of detecting the finish point as in the present embodiment, the K value control may be employed as in the prior art.

Figure 8:
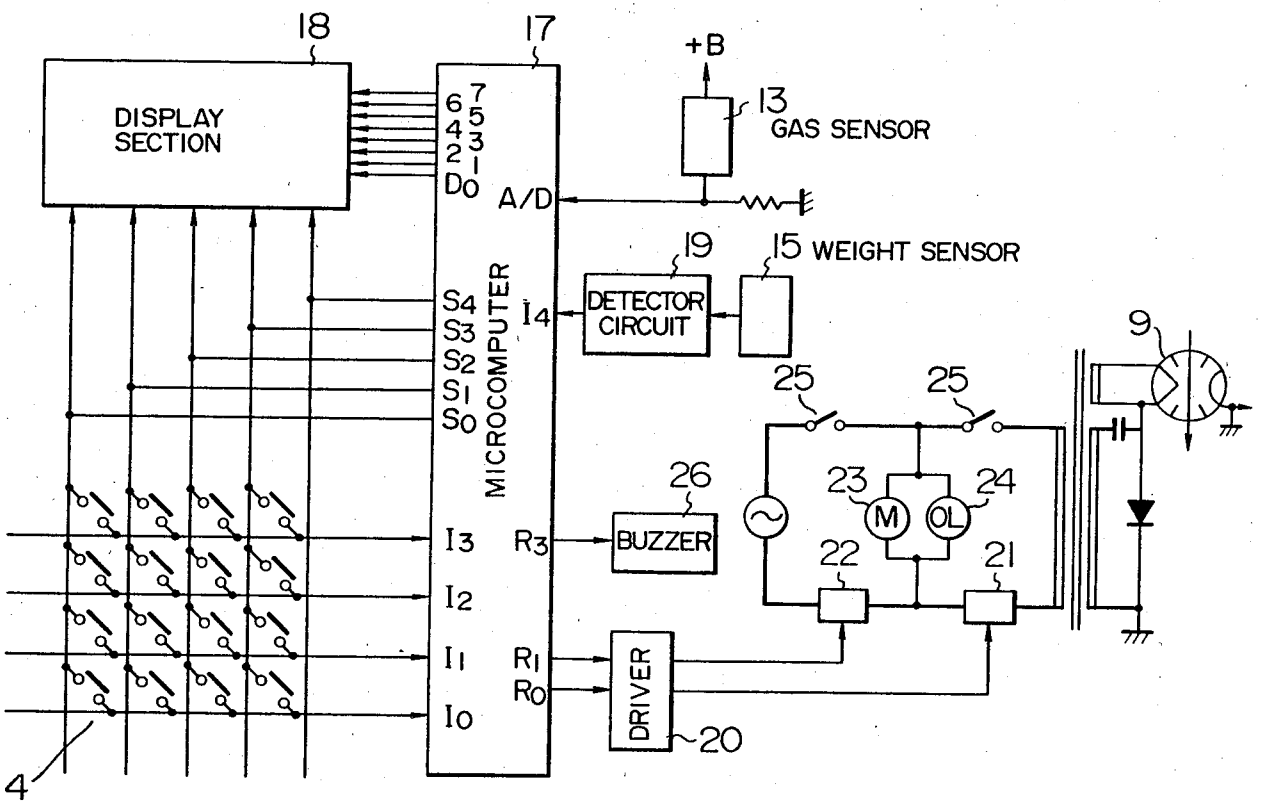
FIG. 8 is a diagram showing a specific circuit.

A specific configuration of the control system is shown in FIG. 8, which is slightly modified from the block diagram of FIG. 7. This system is controlled by a microcomputer 17. The command applied to the input terminals $I_0$ to $I_3$ of the microcomputer 17 from the select key 4 is decoded in the microcomputer to produce a predetermined output. When an input is applied by way of the Reheating key, for instance, the microcomputer 17 makes an indication "A1" on the display section 18 thereof. The display section 18 is driven in a dynamic lighting mode in order to reduce the number of signal lines, so that lighting data is produced at data outputs $D_0$ to $D_7$, and the digit control signal at the digit outputs $S_0$ to $S_4$. The digit control signal is also used for sweep of the key matrix 4.

The gas sensor 13, on the other hand, is connected with an A/D conversion input terminal A/D of the microcomputer 17 by which a resistance variation with temperature is measured. The output of the weight sensor 15 is applied through the detector circuit 19 to the input terminal $I_4$ of the microcomputer 17. The detector circuit 19 is comprised of a bridge circuit and oscillator circuit.

With the start of heating, relay control outputs $R_0$, $R_1$ are produced through a driver 20 from the microcomputer 17. A relay 21 controls the microwave output by interruption, and a relay 22 regulates the power supplied to the heating apparatus. Numeral 9 designates a magnetron for supplying microwave energy to the heating chamber. Numeral 23 designates a motor for a cooling fan or the like, numeral 24 an internal lamp, numeral 25 a door switch responsive to the operation of the door, and numeral 26 a buzzer for announcing the end of heating or the like.

Figure 9:
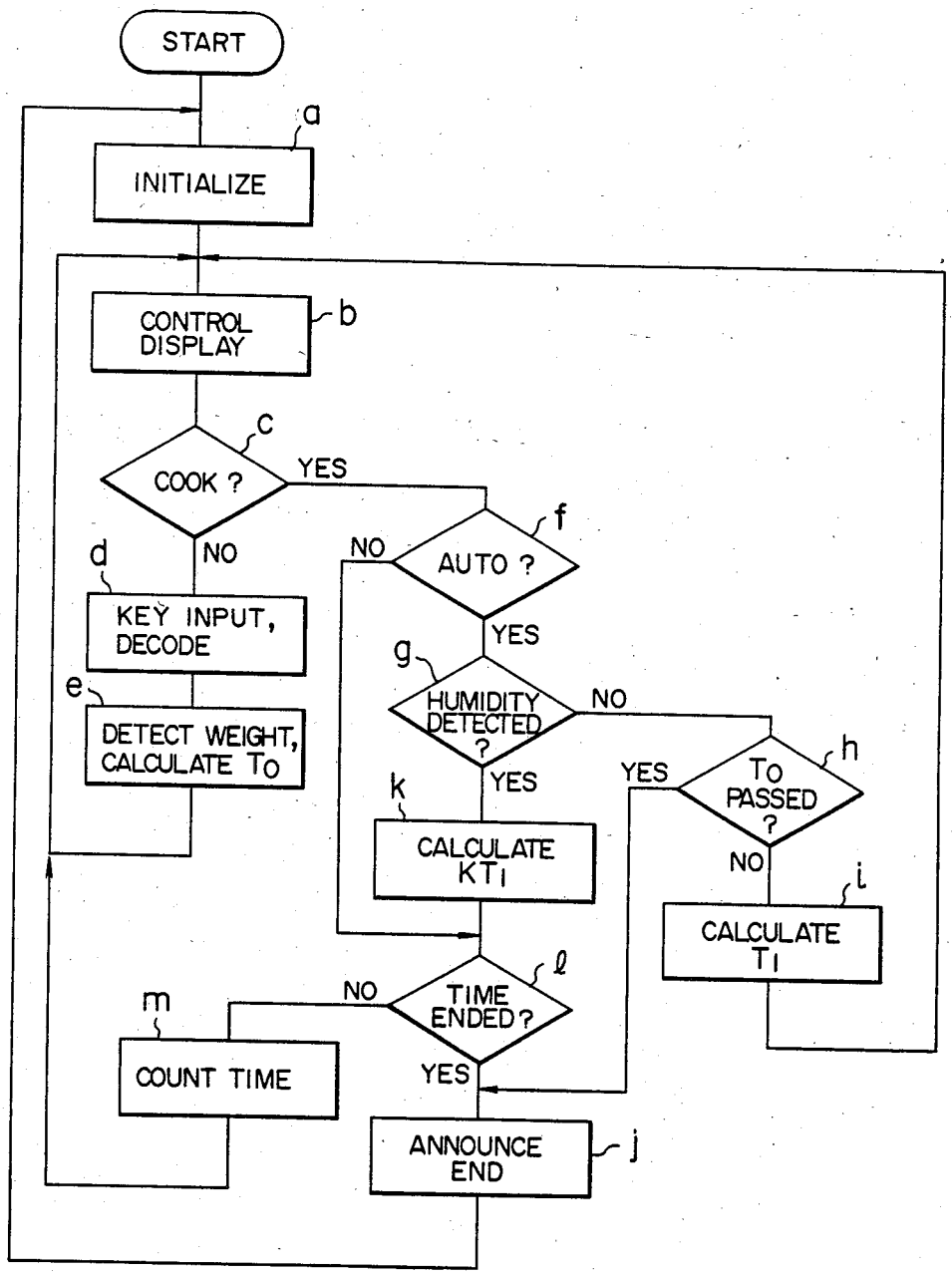
FIG. 9 is a flow chart of a control program.

FIG. 9 is a flowchart of a control program. At the first step a, the microcomputer and the control circuit are initialized, and then the display data are controlled at step b in the manner described in FIG. 8. Step c is for checking whether the cooking is going on. If the cooking is not going on, the key input is decoded at step d, and the weight of the object is detected by the weight sensor and the time $T_0$ is calculated at step e.

With the start of cooking, on the other hand, whether or not automatic cooking is involved is checked at step f, and if the automatic cooking is involved, the step g checks whether moisture is detected or not. If the moisture is not yet detected, step h checks whether the time $T_0$ has passed or not, followed by counting the time $T_1$ at step i. If it is found that the time $T_0$ has already passed, the finish of heating is notified without any moisture detection, thus completing the cooking at j.

If moisture has been detected, by contrast, the time $KT_1$ is calculated at step k, and step l checks whether the time $KT_1$ has passed or not. If the time has not yet passed, the time is counted at step m and the process returns to the entry point of the loop. Then, the finish of heating is announced upon the lapse of the time.

In the case where the step f detects that automatic cooking is not involved, that is, in the manual cooking mode, whether or not a set heating time has passed is monitored at step l.

As explained above, the present invention has the following advantages:

(1) The combined use of a gas sensor and a weight sensor permits the heating apparatus to perform the reheating operations through actuation of the single Reheating key. As a result, the user is not confused as to the key to be operated and it can be correctly operated thus improving the operability. At the same time, each item of the menu is finished to the same satisfactory condition as with the provision of two or three keys in the prior art (a prior-art microwave oven with two keys was estimated as marking 89 evaluation points on a 14-item menu, for example, the same type oven but with the single key according to this invention marked 86 points.).

(2) The gas sensor response or control problem with small food volumes is compensated and improved. The situation in which a small amount or volume of food is liable to be overcooked or overheated with late switching off of the gas sensor can be avoided by the weight sensor control based on the total weight to be heated.

(3) The finish of the food without wrap by the gas sensor can be improved. In the prior art, when the heated state of a food without wrap or cover is detected by a gas sensor, the gas sensor is generally actuated for the actuation of the subsequent control upon the detection of a small amount of steam generated locally before the food is sufficiently heated. According to the present invention, however, the deep threshold value of the gas sensor prevents such detection of a small amount of steam, and therefore, the apparatus performance for foods without wrap is improved. (A microwave oven with the conventional two keys marked 77 evaluation points in the finish of a 26-item menu without wrap, for example, whereas the present apparatus recorded 85 evaluation points with a single key.)

(4) Even when the apparatus is operated unloaded without any food in the heating chamber, the weight sensor operates safely to prohibit the operation of the apparatus or stop it within a short time.

It will be understood from the foregoing description that according to the present invention, there is provided a heating apparatus such as a gas oven or electrical or electronic (microwave) oven or composite type comprising a gas sensor and a weight sensor, in which several conventional operating keys are replaced by a single operation key. Since a plurality of sensors monitor the heating time, the safety is remarkably improved.

I claim:

1. An automatic heating apparatus comprising a microwave power source for heating a load including food and a container in which said food has been placed;

control means connected to said microwave power source for controlling said heating means;

first sensor means connected to said control means for detecting at least one of gas and vapor emitted by said food as it is heated;

second sensor means connected to said control means for detecting the total weight of said food and container; and key means connected to said control means for selectively providing instructions for heating said food, said key means including a single reheat input key to input instructions to said control means for initiating a reheating operation, whereby said control means calculates a maximum period for heating said food, said maximum period being determined by the total weight of said food and container as detected by said second sensor means; and deenergizes said microwave power source upon the occurrence of the first of (1) said first sensor means detects at least one of gas and vapor being emitted by said food in an amount which exceeds a predetermined amount, and (2) said maximum period has elapsed.

2. An automatic heating apparatus comprising heating means for heating a load including an object and a container;

control means connected to said heating means for controlling said heating means;

first sensor means connected to said control means for detecting at least one of gas and vapor emitted from said object as it is heated;

second sensor means connected to said control means for detecting the weight of said load; and key means connected to said control means for selectively providing instructions for heating said object, said key means including a single input key to input instructions to said control means for initiating a reheating operation, whereby said control means calculates a maximum period for heating said object, said maximum period being determined by the weight of said load as detected by said second sensor means;

disables said heating means in response to the presence within a period shorter than said maximum period of at least one of a gas and vapor in an amount larger than a predetermined amount, the presence of at least one of said gas and vapor being detected by said first sensor means; and disables said heating means at said maximum period when said first sensor means does not detect before said maximum period elapses the presence of at least one of a gas and vapor in an amount larger than said predetermined amount.

3. An apparatus according to claim 2, wherein the maximum period $T_0$ for heating said object is calculated from the equation $T_0 = AW_0 + B$, where $W_0$ is the total weight of said load including said object and container, and A and B are predetermined constants.

4. An apparatus according to claim 3, wherein said heating means comprises a microwave power source.

5. An apparatus according to claim 4, wherein said first sensor means is an absolute-humidity sensor for detecting absolute humidity.

6. An apparatus according to claim 3, wherein said first sensor means is an absolute-humidity sensor for detecting absolute humidity.

7. An apparatus according to claim 2, wherein said heating means comprises a microwave power source.

8. An apparatus according to claim 7, wherein said first sensor means is an absolute-humidity sensor for detecting absolute humidity.

9. An apparatus according to claim 2, wherein said first sensor means is an absolute-humidity sensor for detecting absolute humidity.

* * * * *